US008042200B2

(12) United States Patent
Webber

(10) Patent No.: US 8,042,200 B2
(45) Date of Patent: Oct. 25, 2011

(54) WAVE GENERATING APPARATUS

(75) Inventor: Gregory Mark Webber, Monavale (AU)

(73) Assignee: Liquid Time Pty, Ltd., Collaroy, NSW (AU)

( * ) Notice: Subject to any disclaimer, the term of this patent is extended or adjusted under 35 U.S.C. 154(b) by 669 days.

(21) Appl. No.: 11/721,142

(22) PCT Filed: Dec. 9, 2005

(86) PCT No.: PCT/AU2005/001855

§ 371 (c)(1),
(2), (4) Date: Aug. 21, 2008

(87) PCT Pub. No.: WO2006/060866

PCT Pub. Date: Jun. 15, 2006

(65) Prior Publication Data

US 2009/0260146 A1 Oct. 22, 2009

(30) Foreign Application Priority Data

Dec. 9, 2004 (AU) ..... 2004907041

(51) Int. Cl.
*E04H 4/12* (2006.01)
*E04H 4/14* (2006.01)
*E04H 4/00* (2006.01)
*A47K 3/10* (2006.01)

(52) U.S. Cl. ..... 4/491; 4/492

(58) Field of Classification Search ..... 4/488, 490–492; 405/79; 472/128

See application file for complete search history.

(56) References Cited

U.S. PATENT DOCUMENTS

| | | | |
|---|---|---|---|
| 3,802,697 | A | 4/1974 | Le Mehaute |
| 3,913,332 | A | 10/1975 | Forsman |
| 4,792,260 | A | 12/1988 | Sauerbier |
| 4,812,077 | A | 3/1989 | Raike |
| 5,664,910 | A | 9/1997 | Lochtefeld |
| 6,920,651 | B2 | 7/2005 | Roberts |

FOREIGN PATENT DOCUMENTS

| | | |
|---|---|---|
| WO | WO00/05464 | 2/2000 |

*Primary Examiner* — Darren W Gorman
(74) *Attorney, Agent, or Firm* — Fish & Associates, PC

(57) ABSTRACT

The wave-generating apparatus in accordance with the invention has a pool (11) having a deeper area (12) surrounding a substantially central area (13); a pool edge (15) bounding the pool; a body (16) having a wave-generating shaped surface (22) located within the pool adjacent the pool edge and moveable along the pool edge relative thereto to generate a wave (17) in the water in the pool, and impeller means (18) generating a current in the water in a direction opposite to the direction of movement of the body.

13 Claims, 1 Drawing Sheet

WAVE GENERATING APPARATUS

TECHNICAL FIELD

This invention relates to wave-generating apparatus.

The invention has particular but not exclusive application to a wave pool wherein waves are artificially generated in a body of water for recreational use by swimmers, surfers and board riders.

BACKGROUND OF INVENTION

Wave pools as described above are known. It is known for air or fluid impulses to be used to create waves. Each such impulse creates a single wave over or against a structure.

SUMMARY OF INVENTION

The present invention aims to provide an alternative to known wave-generating apparatus.

This invention in one aspect resides broadly in a wave-generating apparatus including:

a pool having a deeper pool area surrounding a substantially central pool area;

a pool edge bounding the pool;

at least one body having a wave-generating shaped surface within the pool adjacent the pool edge and moveable relative thereto to generate a wave in water in the pool, and impeller means which generate a current in the water in a direction opposite to the direction of movement of the at least one body.

As used herein the expression pool is to be given a broad meaning and includes any receptacle, enclosure, excavation or the like adapted to contain a body of water.

In another aspect this invention resides broadly in a method of generating a water wave including:

providing a pool containing water and having a deeper pool area surrounding a substantially central pool area and a pool edge bounding the pool;

moving at least one body having a wave-generating shaped surface within the pool adjacent the pool edge, and generating a current in the water in a direction opposite to the direction of movement of the at least one body.

In a preferred embodiment the central pool area extends out of the water, although the central pool area need not extend out of the water but rather can be of shallow depth. The pool may take various shapes but it is preferred that it is substantially circular.

The body can also be of any shape suitable to generate a wave or wake when drawn or propelled through the water, and is preferably substantially hull-like in shape. It is preferred that one surface of the hull substantially juxtaposes the pool edge as the hull moves through the water.

The impeller means can take various forms including motorised impellers such as paddles and the like, however it is preferred that the impeller means includes at least one jet or propeller directed opposite to the direction of movement of the body. Preferably there is a plurality of jets or propellers radially and/or circumferentially spaced along the floor and/or the wall of the pool.

The direction of the jet or propeller and the direction of the movement of the body can be fixed, but in one preferred embodiment the direction of the jet or propeller and the direction of the movement of the body are reversible.

It is also preferred that the jet(s) or propeller(s) are variably controlled to deliver less power as the reverse current increases or reaches a predetermined level.

It is preferred that the apparatus also includes drive means moving the at least one body relative to the pool edge. The drive means can take various forms and can be shore based or pool based. One example of a pool based drive means is a propeller on the body in the pool. It is preferred that the drive means is shore based, and preferably includes a prime mover moveable in a guideway proximate the pool edge, the body being fixed to the prime mover.

It is preferred that various of the physical parameters within the system are variable. For example the body can be fixed to the prime mover such, that the angle of presentation of the shaped surface of the body, and the depth of the body in the pool, are variable. The shape of the floor of the pool can also be varied to change the profile of the pool floor or to vary the depth of the central portion.

DESCRIPTION OF DRAWINGS

In order that this invention may be more easily understood and put into practical effect, reference will now be made to the accompanying drawings which illustrate a preferred embodiment of the invention, wherein.

DESCRIPTION OF PREFERRED EMBODIMENT OF INVENTION

Figure 1:
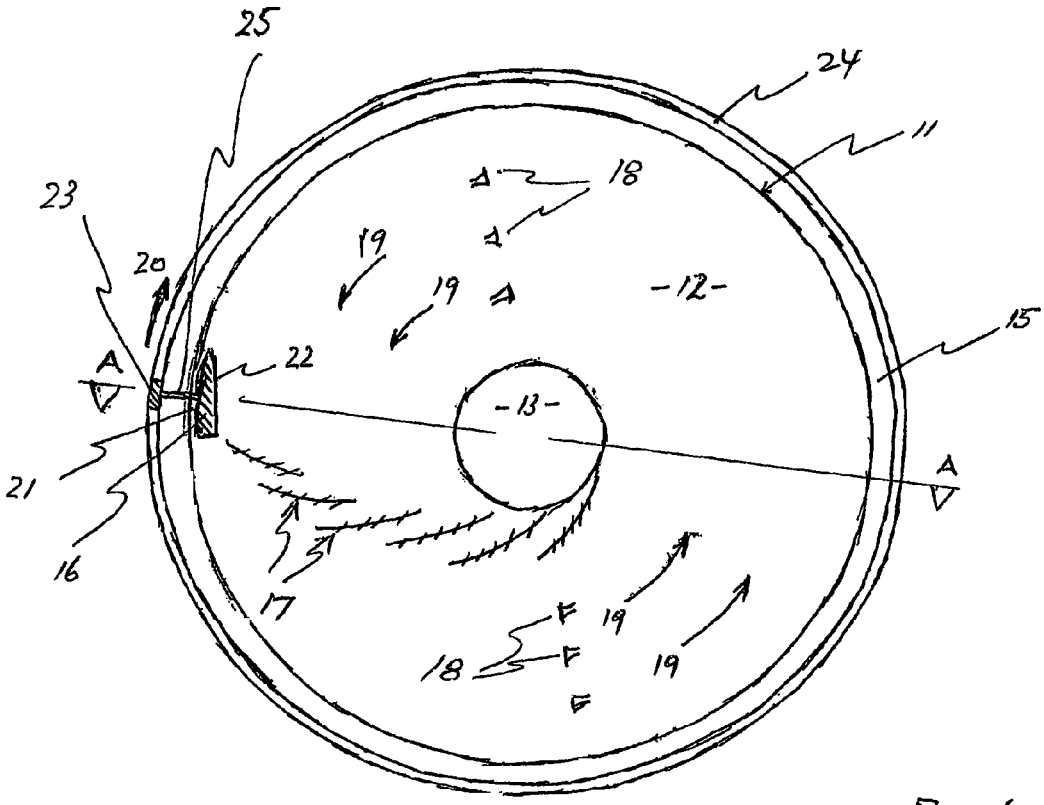
FIG. 1 is a schematic plan view of a wave pool in accordance with the present invention.
Figure 2:
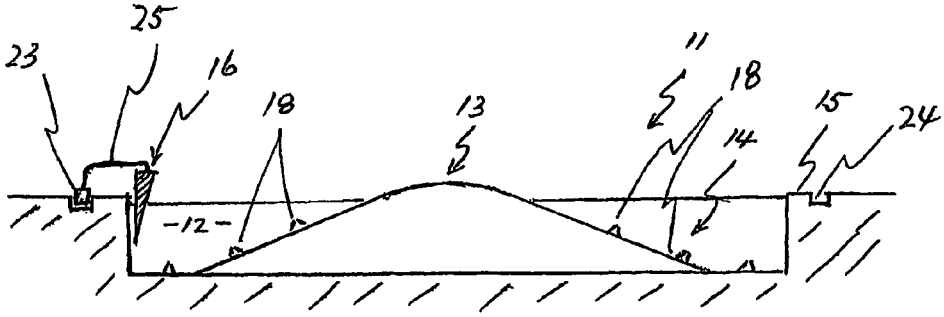
FIG. 2 is a cross sectional elevation of the wave pool seen in FIG. 1 through central axis AA.

As can be seen in FIGS. 1 and 2, a wave-generating apparatus in accordance with the invention has a pool 11 having a deeper area 12 surrounding a substantially central area 13, which in FIG. 2 is seen extending out of the water 14. A pool edge 15 bounds the pool. A body having a wave-generating shaped surface in the form of a hull 16 is located within pool 11 adjacent pool edge 15, and is moveable along pool edge 15 relative thereto to generate a wave 17 in the water in the pool. Impeller means in the form of jets 18 generate a current in the water in a direction 19 opposite to the direction of movement 20 of the body 16.

Whilst the central area 13 is shown extending out of the water in FIGS. 1 and 2, the central area 13 can be submerged to provide a shallower area on which wave 17 can break. As shown in FIG. 2, the floor of the pool 11 can be shaped or contoured or sloped to approximate the bottom ramp of the ocean floor as it approaches the shore. Pool 10 as shown is substantially circular, but it will be appreciated that the pool can take other shapes.

The body, as shown preferably in FIGS. 1 and 2, is substantially hull-like, and one surface 21 of the hull 16 substantially juxtaposes the pool edge 15 as hull 16 moves therealong under the action of drive means. The opposite surface 22 of hull 16 is shaped and angled to generate wave 17. Various shapes are possible including a substantially planar shape, or preferably, a convex shape such as a volute designed to roll the wave. Although only one hull is illustrated in FIG. 1, it will be appreciated that more than one hull can be used.

As illustrated schematically in FIGS. 1 and 2, the drive means in this preferred embodiment is a prime mover 23 moveable in a guideway 24 proximate the pool edge 15, and hull 16 is fixed to prime mover 23 by means of arm 25. Prime mover 23 is not illustrated in detail but could be driven by an electric motor and arranged to track within guideway 24 around the pool. Alternatively, and again not illustrated here, the guideway could be a rail track along pool edge 15 and the prime mover could be a linear motor tracking along the rail. Yet again in another embodiment, the drive means could be a motor driving a propeller on the hull. In a manner not illustrated, the hull 16 or other body can be fixed relative to the pool edge 15 such that the angle of presentation of the shaped surface of the body, and the depth of the body in the pool, are both variable. Typically this can be effected by hydraulic actuators arranged to vary the angle and the depth.

Although not illustrated, it will be noted that the direction of the jets 18 is reversible, as is the direction of the movement of hull 16. It should also be noted that the shape of the floor of the pool is variable to increase or decrease the underwater shoreline profile to cause varying wave breaking patterns, ie whether gently breaking, aggressively pitching etc. These wave characteristics are also variably in accordance with other parameters such as the angle of presentation of the hull, its depth in the water, the speed of hull through the water and the velocity of the reverse current generated by the jets 18 or other impeller means.

Typically the pool could be 100 meters in diameter and 2 meters maximum depth, the central island portion being up to approximately 30 meters in diameter.

It will be appreciated that the movement of a wedge- or hull-shaped body around the perimeter of the pool generates a set of waves like a boat wake. These waves are aligned with the shallower central section which causes several of the waves to break around the perimeter, thus mimicking waves as they break in nature. The reverse current generated by the jets or other impeller means offsets any current created by the hull moving through the pool, and increases the wave height.

It is preferred that high velocity jets or high revolution small diameter propellers are utilised to initiate the reverse current, and that once the reverse current reaches an initial velocity, then larger diameter lower revolution propellers maintain the current. The high velocity jets and high revolution small diameter propellers are more suited to bring the reverse current to an initial level from standstill, but are inefficient to use to maintain operation. Alternatively large diameter propellers could be used at varying rates of revolution, ie higher revs to bring up to speed, and then lower revs to maintain the required level of reverse current.

The effect of this reverse current is to offset any current which would otherwise be created in the direction of movement of the foil and of the resultant waves.

Whilst a small number of foils in a relatively large diameter pool would have minimal current in the direction of movement of the foil such that generation of a reverse current is less desirable, a much larger area would be required to have many waves breaking in the pool at once. Such a pool would diminish cost effectiveness, in terms of rate of income from users and it is estimated that a pool of about 500 meters diameter would probably be needed to get 4 foils working without formation of a current in the direction of foil movement. However by generating a reverse current as described above, a pool as small as 120 meters diameter could include 4 foils making two waves per foil, without any current forming In the direction of foil movement.

Another way of minimising formation of a current In the direction of foil movement without the need to generate a reverse current involves a straight pool wherein the foil direction could be reversed, so that it would run into any current which was created by the previous passage of the foil. The foil, if asymnetrical throughout its length, could be rotated by 180 degrees and moved in the opposite direction. Alternatively, if symetrical throughout its length, the foil need not be rotated through 180 degrees but merely reversed. However a reversible straight pool design loses efficiency because of the time taken to reverse the foil, and because of the time and distance taken for the waves to generate (it takes 100 meters for a vessel to form a set of one meter wake waves from a standing start). Consequently the number of waves generated over a given distance is low. Consecutive foils running in the same direction in a straight pool would run into the current made by the previous foils and would require significant gaps between each foil to still create adequate waves. To get 4 foils running at the same time would require a pool of about 1 km in length to function properly, and so cost in terms of land use would be high. Spectator interest would also be low.

A reverse current generated as described will also steepen the face of each wave and correspondingly increase the strength or power of the wave due to the wedging of two wave fronts to create a peaking wave of increased height. This allows for an increased length of ride for a user of the facility.

The circular pool with reverse current has been found to maximise the number and size of the waves whilst minimising pool size and consequently the cost of the installation.

The present invention has a number of advantages over known wave pools which utilise air, water and structures to create one wave per release or displacement thereby using more energy than the present wave pool system because with the present invention only a short length of wave needs to be created because the wave continues in the pool, wherein moreover, the reverse current develops a continuing momentum not possible in a straight pool of limited length.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

The invention claimed is:

1. A wave-generating apparatus including:

a pool having a deeper pool area surrounding a substantially central pool area;

a pool edge bounding the pool;

a hull-shaped body having a wave-generating shaped surface within the pool adjacent the pool edge and moveable relative thereto to generate a set of wake-type waves in water in the pool, wherein the wave-generating shaped surface has a substantially planar shape or a convex shape; and an impeller mechanism which generates a current in the water in a direction opposite to the direction of movement of the hull-shaped body.

2. A wave-generating apparatus as claimed in claim 1, wherein the central pool area extends out of the water.

3. A wave-generating apparatus as claimed in claim 1, wherein the central pool area is of shallow depth.

4. A wave-generating apparatus as claimed in claim 1, wherein the pool is substantially circular.

5. A wave-generating apparatus as claimed in claim 1, wherein one surface of the hull-shaped body substantially juxtaposes the pool edge as the hull-shaped body moves through the water.

6. A wave-generating apparatus as claimed in claim 1, wherein the impeller mechanism includes at least one jet directed opposite to the direction of movement of the hull-shaped body.

7. A wave-generating apparatus as claimed in claim 6, wherein the direction of the jet and the direction of the movement of the hull-shaped body are reversible.

8. A wave-generating apparatus as claimed in claim 6, and including a plurality of jets radially and/or circumferentially spaced along a floor and/or a wall of the pool.

9. A wave-generating apparatus as claimed in claim 1, and including a drive mechanism moving the hull-shaped body relative to the pool edge.

10. A wave-generating apparatus as claimed in claim 9, wherein the drive mechanism is a prime mover moveable in a guideway proximate the pool edge, the hull-shaped body being fixed to the prime mover.

11. A wave-generating apparatus as claimed in claim 10, wherein the at hull-shaped body is fixed to the prime mover such that the angle of presentation of the shaped surface of the hull-shaped body, and the depth of the hull-shaped body in the pool, are variable.

12. A wave-generating apparatus as claimed in claim 1, wherein the pool has a floor that is contoured or sloped in shape.

13. A method of generating a water wave including:

providing a pool containing water and having a deeper pool area surrounding a substantially central pool area and a pool edge bounding the pool;

moving a hull-shaped body having a wave-generating shaped surface within the pool adjacent the pool edge to thereby generate a set of wake-type waves, wherein the wave-generating shaped surface has a substantially planar shape or a convex shape; and generating a current in the water in a direction opposite to the direction of movement of the hull-shaped body.

* * * * *